US012780389B2

(12) United States Patent
Zhang et al.

(10) Patent No.: US 12,780,389 B2
(45) Date of Patent: Nov. 3, 2026

(54) CLOSED-LOOP AUTOMATIC CONTROL SYSTEM FOR SHIP SPEED AND METHOD THEREOF

(71) Applicant: SHANGHAI MARITIME UNIVERSITY, Shanghai (CN)

(72) Inventors: Chunchang Zhang, Shanghai (CN); Guichen Zhang, Shanghai (CN); Mengwei Chen, Shanghai (CN); Taishan Chen, Shanghai (CN)

(73) Assignee: SHANGHAI MARITIME UNIVERSITY, Shanghai (CN)

( * ) Notice: Subject to any disclaimer, the term of this patent is extended or adjusted under 35 U.S.C. 154(b) by 136 days.

(21) Appl. No.: 19/021,712

(22) Filed: Jan. 15, 2025

(65) Prior Publication Data

US 2026/0054819 A1 Feb. 26, 2026

(30) Foreign Application Priority Data

Aug. 20, 2024 (CN) ..... 202411139268.3

(51) Int. Cl.
*B63H 21/21* (2006.01)
*B63B 79/40* (2020.01)

(52) U.S. Cl.
CPC ..... *B63H 21/21* (2013.01); *B63B 79/40* (2020.01); *B63H 2021/216* (2013.01)

(58) Field of Classification Search
CPC .. B63H 21/21; B63H 2021/216; B63B 79/40; G05B 19/0423; G05B 2219/25257
See application file for complete search history.

(56) References Cited

U.S. PATENT DOCUMENTS 12,110,088 B1 * 10/2024 Derginer ..... B63H 25/42
2017/0313397 A1 11/2017 Ni

FOREIGN PATENT DOCUMENTS

CN 101462590 A 6/2009
CN 111352341 A 6/2020
(Continued)

OTHER PUBLICATIONS

Sun Ning, Research on Adaptive Control Algorithms for Marine Diesel Engine Speed Regulation System, China Excellent Master's Dissertation Full-text Database Engineering Science and Technology Series II, No. 11. Date of issue: Nov. 15, 2019, Related pp. C036-12 Claims involved: 1-10.

(Continued)

*Primary Examiner* — Sheetal R Paulson
(74) *Attorney, Agent, or Firm* — Pilloff Passino & Cosenza LLP; Rachel K. Pilloff; Sean A. Passino

(57) ABSTRACT

A closed-loop automatic control system for ship speed and a method are provided, including the following steps: obtaining feedback information through a detection feedback module, and generating a final effective main engine speed order $n_E$* through an outer-loop control module; through the middle-loop control module, the main engine speed order $n_E$* is compared with the main engine speed n by the speed deviation Δn, which uses PID and other control algorithms, the final effective main engine fuel quantity order $L_S$* is generated; through the inner-loop control module, generating the fuel quantity deviation ΔL between the main engine fuel quantity order $L_S$* and fuel quantity feedback signal L into an optimized fuel quantity value S; and completing the closed-loop adjustment of fuel injection quantity (FIQ).

10 Claims, 2 Drawing Sheets

(56) References Cited

FOREIGN PATENT DOCUMENTS

| | | | | | |
|---|---|---|---|---|---|
| CN | 112435505 | A | | 3/2021 | |
| CN | 114740910 | A | | 7/2022 | |
| CN | 114779639 | A | | 7/2022 | |
| CN | 115180105 | A | * | 10/2022 | ..... B63H 3/00 |

OTHER PUBLICATIONS

Haoyu Hu, et al., Research on the method of controlling ship heading propulsion system based on PID control 2023 IEEE 6th InternationalConference on Automation, Electronics and ElectricalEngineering (AUTEEE), Date of issue: Dec. 17, 2023, pp. 1154-1157 Related pages: Full text Claims involved: 1-10.

Retrieval report dated Sep. 25, 2024 in SIPO application No. 202411139268.3.

Office action dated Oct. 8, 2024 in SIPO application No. 202411139268.3.

* cited by examiner

CLOSED-LOOP AUTOMATIC CONTROL SYSTEM FOR SHIP SPEED AND METHOD THEREOF

CROSS-REFERENCE TO RELATED APPLICATIONS

This application claims priority to Chinese Patent Application No. 202411139268.3, filed on Aug. 20, 2024, the contents of which are hereby incorporated by reference.

TECHNICAL FIELD

The disclosure relates to ship speed optimization control in the shipping field, and particularly a closed-loop automatic control system for ship speed and a method thereof.

BACKGROUND

Ship speed is one of the key indicators of the shipping economy, which has attracted the attention of shipowners, cargo owners and charterers in ship operation. The ship speed is obtained by driving the propeller of the main engine to push the ship to overcome the resistance of wind and waves, and it is realized by controlling the main engine's speed. According to the matching theory of ship engine and propeller, there is a corresponding relationship between ship speed and propeller speed and main engine's speed in calm conditions. The marine low-speed two-stroke main engine directly drives the propeller, and the main engine speed is the same as the propeller speed; the marine medium-speed engine drives the propeller through the gearbox, and there is a variable ratio relationship between the speed of the medium-speed engine and the propeller speed. The ship's electric propulsion system regulates the ship speed by controlling the speed of the driving motor through the frequency converter, so controlling the engine speed or the propulsion motor indirectly regulates the ship speed.

However, the nonlinear correspondence between the propeller speed and the ship speed is affected by the sea conditions, and only controlling the diesel engine speed may not ensure the stability of the ship speed. This is because the current ship speed control is open-loop, the driver sets the main engine speed through the joystick, and the main engine speed is limited by the engine control room to change the fuel injection amount supplied to the main engine, to realize the closed-loop adjustment of the main engine speed and indirect control of the ship speed. There is a ship speed-main engine speed correspondence table next to the joystick on the bridge to make it clear. However, due to the influence of wind, waves, dirty hull, etc., the ideal corresponding relationship between the main engine speed and the ship speed changes, and the speed generated by propelling the ship at the same main engine speed will increase (such as downwind and downstream, etc.) or decrease (such as headwind, countercurrent, dirty hull, etc.). Because there is no real-time feedback of ship speed, no closed-loop control is formed, causing unstable speed, so it is not ideal to realize stable ship navigation only by controlling the main engine speed or propulsion motor speed and propeller speed, and the main goal of ship navigation is to require the stability of ship speed and the safe operation of the main engine.

In particular, the ship's against wind and current, and the serious hull fouling will lead to problems such as overload and black smoke of the main engine, and the performance of the main engine will deteriorate under the influence of bad sea conditions. There is much literature about ship speed optimization, which is based on the ship propulsion mechanism to construct an optimization principle model to calculate the fuel consumption of the main engine. Even if the ship speed optimization considers weather and sea conditions, its practicability and accuracy are very low, and the fundamental reason is the open-loop control of ship speed. The open-loop control leads to the deterioration of the accuracy of ship speed. Both the OOW and the ship control system ignore the change of resistance at the ship speed and pay no attention to the change of main engine speed corresponding to the ship speed and the causes of abnormality.

SUMMARY

The objective of the present disclosure is to solve the above shortcomings and to provide a system or method that may realize closed-loop optimal control of ship speed, to ensure stable and controllable navigation of the ship and safe operation of the main engine.

To achieve the above objective, the disclosure provides a closed-loop automatic control system for ship speed, which includes the following modules:

A detection feedback module, used for detecting and acquiring feedback information and converting the feedback information into feedback signals;

- an outer-loop control module, used for converting outer-loop ship speed control into middle-loop main engine speed control by using the feedback signals;
- a middle-loop control module, used for realizing closed-loop control of a main engine speed and converting the middle-loop main engine speed control into inner-loop fuel injection quantity (FIQ) control;
- an inner-loop control module, used for realizing a closed-loop adjustment of the main engine FIQ, so as to realize closed-loop automatic control of the ship speed.

Further, the feedback information includes a main engine shaft power $P_s$, a main engine speed n, the ship speed $V_s$ and an amount of fuel supplied to the main engine L. Among them, the main engine shaft power $P_s$ is detected by the shaft power meter, the main engine speed n is detected by the use of proximity switch at the flywheel, the ship speed $V_s$ is obtained by the ship voyage recorder or GPS, the fuel injection quantity L of the electronic fuel injection main engine is obtained by the displacement sensor of FIVA or the piston displacement sensor of the hydraulic high-pressure oil pump, and the fuel injection quantity L of the main engine of the mechanical high-pressure oil pump is detected by the displacement sensor or the servo actuator motor encoder.

Further, the feedback signals are analog signals of 4-20 mA or 1-5 V. The feedback signal also needs to be scaled to meet the signal requirements of each closed-loop.

Further, the system is started by a function setting module, which has the functions of the telegraph transmitter and speed setting, and is used for transmitting bridge orders, and an electric signal of 0-10 V, 0-5 V or ±5V is generated by a potentiometer as an bridge order and speed setting values; a ship speed control mode or a main engine control mode is selected through the function setting module; the closed-loop automatic control system for ship speed is started by selecting the ship speed control mode; in the ship speed control mode, the ship speed $V_s$* is set.

Further, the function setting module is implemented by using the bridge hybrid telegraph lever, and the hybrid telegraph lever has 11 positions, including deadslow-speed, slow-speed, half-speed, full-speed and emergency astern speed for astern (AS), deadslow-speed, slow-speed, half-speed, full-speed and navigation full speed for ahead (AH), and ship stopping (ST).

the telegraph lever passes through the function setting module, and after the select switches, S1 and S2 are set to the left position EC, the main engine control mode is selected, and the main engine's speed is set, at this time, the main engine speed is controlled in closed-loop and the ship speed is controlled in open-loop;

the telegraph lever passes through the function setting module, and after the select switches S1 and S2 are set to the right position BC, the ship speed control mode is selected, and the ship speed $V_s$* is set, and the ship speed is controlled in closed-loop at this time.

Further, the outer-loop control module includes:

a ship power demand sub-module: based on a ship power-speed matching algorithm, used to generate a main engine power variable ΔP* by passing a speed deviation $\Delta V_s$ between a set speed $V_s$* and an actual speed $V_s$ through a ship resistance model, and then obtain a main engine power $P_E$* required by a ship power-speed matching algorithm;

the calculation formula 1 of the speed deviation is: $\Delta V_s = V_s^* - V_s$;

the calculation formula 2 of the ship resistance model is: $\Delta P^* = K_S(\Delta V_s)^3$, where $K_S$ is the ship resistance coefficient, and the sea conditions and ship conditions all affect the value of $K_S$;

the calculation formula 3 of the main engine power $P_E$* required by the ship is: $P_E^* = P_s \pm \Delta P^*$, where $P_s$ is the propulsion power required by the ship at the corresponding speed, that is, the main engine shaft power obtained by the shaft power meter in the above feedback signal; $\Delta P^* = \Sigma(\delta p^*)$, δp* is the power of each adjustment, so as to prevent the power step change caused by excessive single adjustment quantity of power and affect the stability of the main engine.

a main engine speed generation sub-module: based on a main engine speed-power algorithm, used to obtain a main engine speed $n_s$* corresponding to the required speed of the ship from the main engine power $P_E$* required by a ship propulsion formula; the ship propulsion formula 4 is:

$$P_E^* = K_Q(n_s^*)^3$$

where $K_Q$ is the torque coefficient; meanwhile, $n_s^* - P_E^*$ is in the allowable range of ship propulsion characteristics, that is, meeting the ship-main engine matching design curve.

the main engine speed setting sub-module: generating main engine speed order n* by the main engine speed $n_s$* required by the ship speed control, which automatically adapts to the ship speed and realizes the ship speed control;

the main engine speed order limiting sub-module: used to generate a final effective main engine speed order $n_E$* after the main engine speed order n* is subjected to main engine speed limit. In the main engine speed order limiting sub-module, the main engine speed order n* output by ship speed control needs to go through the main engine speed limit, including the minimum stable speed limit, critical speed limit, chief engineer setting speed limit, acceleration rate limit, program load limit and maximum speed limit. The main engine speed order n* with these speed limits are compared, and if n* exceeds these limits, n* will not work, so the speed order selects the speed limit value, and after passing the speed limit, the final main engine speed order is $n_E$*.

Further, in the main engine speed setting sub-module, the ship speed control is divided into gradual tracking control (changing the set value of ship speed $V_s$*) and speed keeping control (constant value of ship speed $V_s$*):

A) The method of gradual tracking control is as follows: when the ship speed is under the control of follow-up or acceleration and deceleration program, in order to prevent the main engine from suddenly increasing or decreasing the load due to the large inertia of the ship, the main engine speed order n* is set through the adjustable speed interval time ΔT and speed adjustment amplitude Δn, so that the main engine speed given value may be gradually tracked to $n_s$*, so that the ship speed $V_s$ may be gradually tracked to the set speed $V_s$*; among them, the gradual tracking formula 5 is $$n_s^* = n^* \pm \sum_i^m (\delta n),$$

where δn is the absolute value type speed adjustment quantity, "+" means the speed increase adjustment, and "–" means the speed decrease adjustment;

$$T = \sum_i^m (\delta T),$$

m is the number of adjustments, i=0, 1, . . . m; T is the total adjustment time, δT is the variable interval time of each adjustment, and δT depends on the ship inertia. When the ship inertia is large, δT is large, and when the ship inertia is small, δT is small, so that the actual speed approaches the given speed in the form of rising curve, so that the ship speed $V_s$ may gradually track the set speed $V_s$*.

B) The method of speed keeping control is as follows: when the speed keeps the constant value control of $V_s$*, when the actual ship speed $V_s$ deviates from the given ship speed $|\Delta V_s| \le V_{DB}$, $V_{DB}$ is a settable speed dead zone; when $\Delta V_s$ is within the speed dead zone, the ship speed controller does not act, and the $V_{DB}$ dead zone value may be set according to the sea conditions, such as $V_{DB}$=0.1 knots in calm sea conditions, and $V_{DB}$=2 knots in bad sea conditions. If $\Delta V_s$ exceeds the ship speed dead zone, that is, $|\Delta V_s| > V_{DB}$, a new main engine set speed $n_s$* is generated, that is, $n_s^* = f(\Delta V_s)$, and the function $f(\Delta V_s)$ includes the ship power-speed algorithm and the main engine speed-power algorithm, that is:

$$f(\Delta V_s) = \sqrt[3]{\left[\eta\left(P_s \pm K_s(\Delta V_s)^3\right)\right] / \left(2\pi\rho D_p^5 K_Q\right)}$$

Where η is the efficiency of the main engine propulsion system, ρ is the seawater density, $D_p$ is the diameter of the propulsion propeller, $K_Q$ is the torque coefficient, and $P_s$ is the propulsion power required by the ship at the corresponding speed, that is, the main engine shaft power obtained by the shaft power meter in the above feedback signals.

Further, the middle-loop control module includes a main engine speed closed-loop control sub-module and a main engine load limit sub-module:

the main engine speed closed-loop control sub-module is used for converting the speed deviation $\Delta n$ compared with the main engine speed order $n_E^*$ and the main engine actual speed n through a main engine speed controller to obtain a set value $L_E^*$ of the amount of fuel supplied to the engine;

the calculation formula 6 of speed deviation $\Delta n$ is: $\Delta n = n_E - n$;

the main engine load limit sub-module is used for generating a final effective fuel order supplied to the engine $L_S^*$ after the set value $L_E^*$ of the amount of fuel supplied to the engine is subjected to load limit. Load limits include minimum fuel supply limit, starting fuel supply setting limit, scavenging air pressure limit, torque limit and maximum fuel supply limit. Comparing the set value $L_E^*$ of the amount of fuel supplied to the engine with these load limits, if $L_E^*$ exceeds the load limits, $L_E^*$ will not work, and the fuel order supplied to the engine will select the load limit value, and finally an effective fuel order supplied to the engine as $L_S^*$ is generated after passing the load limits.

Further, the main engine speed controller mainly adopts PID algorithm, supplemented by machine learning algorithm; learning the ship speed $V_s$ and the changes to compensate for PID speed adjustment algorithm, and the machine learning algorithm will only be effective after PID action; PID control parameters include proportional coefficient $K_p$, integral coefficient $K_i$ and differential coefficient $K_d$, which need manual experience setting and online optimization. The machine learning algorithms are fuzzy neural network, genetic algorithm, evolutionary algorithm, particle swarm optimization algorithm, support vector machine, etc. The machine learning algorithm is used to fine-tune PID control parameters or superimpose them on PID output, and as a compensation function, machine learning algorithm may prevent the main engine speed from overshoot, oscillation or untimely control.

Further, the inner-loop control module includes:

a fuel limit supplied to the engine sub-module: used for comparing the setting amount of fuel supplied to the engine $L_S^*$ with the amount of fuel feedback signals L to obtain a fuel injection quantity (FIQ) deviation $\Delta L$, and generating $\Delta L_S$ after a fuel dead zone limit;

a FIQ scale calibration sub-module: after the generated $\Delta L_S$ is calibrated by fuel-speed, a FIQ order S* after a FIQ scale calibration is generated;

fuel-speed calibration processing method: $\Delta L_S$ is calibrated by FIQ scale signal (ordinate) and main engine speed signal (abscissa) to improve the accuracy of FIQ adjustment, and FIQ order after fuel-speed scale calibration is S*.

A FIQ scale adjustment sub-module: used for passing the FIQ order S* through a fuel supply controller to generate a FIQ S; among them, the FIQ order S* is the given value of the fuel injection actuator, which is divided into servo motor FIQ control and FIVA or ELFI hydraulic FIQ control. The former has an angle encoder to complete the closed-loop adjustment of FIQ control, and the latter uses displacement sensor to detect the stroke of fuel injection plunger to complete the closed-loop adjustment of FIQ.

Further, due to the great difference of fuel quality supplied to the main engine, the power generated by the main engine is different after the fuel with the same injection quantity, which will lead to the control system misjudging whether the control function is weak or strong and further increasing or decreasing the FIQ; on the other hand, bad sea conditions, against wind and current, dirty hull, etc. will increase the ship's resistance and make the ship speed-propulsion power matching abnormal. Therefore, the FIQ controller is also equipped with a fuel quality optimization control sub-module, which compares and analyzes the actual ship speed $V_s$-actual propulsion shaft power $P_s$ matching curve with the ideal speed-power matching curve based on the ship speed (abscissa)-power (ordinate) matching curve, and use the fuel injection actuator to optimize FIQ control and realize the fuel quality closed-loop adjustment.

The FIQ controller mainly adopts PI control algorithm, and utilizes the fuel quality optimization control sub-module to optimize the proportional coefficient and integral coefficient of FIQ control intensity, so as to realize the optimal matching between the ship and the main engine, prevent frequent changes, fuel injection overshoot and unstable load of the main engine, and adapt to changes in sea conditions and ship conditions, such as against wind and current or dirty hull, etc. If the $V_s$-$P_s$ curve becomes steep, the control coefficient of the FIQ controller PI will be weakened to prevent the main engine from being overload.

Further, the method for fuel quality optimization control includes the following steps:

the actual ship speed $V_s$- power $P_s$ matching curve and the ideal speed-power matching curve are compared and analyzed as follows:

1) if the $V_s$-$P_s$ matching curve is steeper than the ideal speed-power matching curve, that is, more propulsion power is needed at the same speed, and the main engine FIQ becomes larger, which indicates that the ship resistance becomes larger, at this time, the control system may not further increase the FIQ to meet the set speed, and it is allowed that the actual speed does not reach the given speed, so as to prevent the main engine from being overloaded and the ship's energy efficiency from getting worse.

2) If the $V_s$-$P_s$ matching curve is below the ideal speed-power matching curve, that is, less propulsion power is needed at the same speed, and the amount of fuel supplied to the engine becomes smaller, indicating that the ship is downwind and downstream, and the resistance is reduced. At this time, the control system will further reduce the FIQ until the actual speed is kept within a given speed range, so as to realize the fuel saving of the main engine and improve the energy efficiency of the ship.

3) The $V_s$-$P_s$ matching curve is the best matching, and the FIQ adjustment is directly optimized to prevent the ship speed control from oscillating and the FIQ control from entering saturation.

Further, the FIQ signal is 1-5 V or 4-20 mA.

Further, in the fuel limit sub-module, the method of FIQ dead zone limit processing includes the following steps:

the FIQ deviation calculation formula 7 is: $\Delta L = L_S^* - L$;

comparing $|\Delta L|$ with a settable fuel quantity FIQ dead zone $L_{DB}$, a dead zone value of $L_{DB}$ is capable of being set according to sea conditions, in calm sea conditions, $L_{DB}$ is a minimum value, and in bad sea conditions, $L_{DB}$ is a maximum value, so as to prevent frequent actions of fuel injection actuator;

when $|\Delta L| \leq L_{DB}$, when $\Delta L$ is in a dead zone, output of the FIQ controller remains unchanged, and the fuel injection actuator does not act;

when $|\Delta L| > L_{DB}$, the output of the FIQ controller starts to change, and the fuel injection actuator acts.

The disclosure also provides a closed-loop automatic control method for ship speed, including the following steps based on the closed-loop automatic control system for ship speed:

S1, obtaining the feedback information through the detection feedback module, where the feedback information includes the main engine shaft power $P_s$, the main engine speed n, the ship speed $V_s$ and the amount of fuel supplied to the main engine L;

S2, passing the speed deviation $\Delta V_s$ between the set speed $V_s$* and the actual speed $V_s$ through the outer-loop control module to generate the final effective main engine speed order $n_E$*, so as to realize a conversion from the outer-loop ship speed control to the middle-loop main engine speed control;

S3, converting the speed deviation Δn compared with the main engine speed order $n_E$ and the main engine actual speed n through the middle-loop control module to generate the final effective main engine FIQ order $L_S$*, so as to realize a conversion from the middle-loop main engine speed control to the inner-loop FIQ control;

S4, comparing the main engine FIQ order $L_S$* with the FIQ feedback signals L to obtain the FIQ deviation ΔL, and generating an optimized FIQ S through the inner-loop control module to realize the FIQ closed-loop adjustment.

Further, step S2 is specifically:

2.1: through formula 1, the speed deviation $\Delta V_s$ between the set speed $V_s$* and the actual speed $V_s$ of the ship is obtained;

2.2: through the ship power demand sub-module, the main engine power variable ΔP* is generated from the ship speed deviation $\Delta V_s$ according to formula 2, and then the power $P_E$* of the main engine required by the ship is obtained according to formula 3;

2.3: through the main engine speed generation sub-module, the main engine power $P_E$* required by the ship is substituted into formula 4 to obtain the main engine speed $n_s$* required by the ship;

2.4: the main engine speed $n_s$* required by the ship is input into the main engine speed setting sub-module to generate the main engine rotating order n*;

2.5: the main engine speed order n* is input into the main engine speed order limiting sub-module to obtain the final main engine speed order $n_E$* generated after the speed limit.

Further, step S3 is specifically:

3.1: through formula 6, the speed deviation Δn between the main engine speed order $n_E$* and the main engine feedback speed n is obtained;

3.2: An is input into the main engine speed controller to obtain the main engine FIQ order $L_E$*;

3.3: the main engine FIQ order $L_E$* is input into the main engine load limit sub-module, and the final effective main engine FIQ order $L_S$* is generated after load limit processing.

Further, step S4 is specifically:

4.1: using formula 7, the FIQ deviation ΔL between the effective main engine FIQ order $L_S$* and the feedback FIQ L is obtained;

4.2: the FIQ deviation ΔL is input into the FIQ limit sub-module, and $\Delta L_S$ is generated after the FIQ dead zone limit processing;

4.3: the generated $\Delta L_S$ is passed through the fuel-speed scale calibration sub-module, and after the fuel-speed calibration process, the calibrated FIQ scale order S* is generated;

4.4: the FIQ scale order S* calibrated by the fuel-speed scale adjustment sub-module, and through the fuel injection controller, the fuel displacement/fuel injection amount is generated, namely the FIQ actual scale S; the FIQ actual scale S is transmitted to the fuel injection actuator for FIQ adjustment, so as to change the amount of fuel into the cylinder by the main engine in each cycle.

The premise of closed-loop control of ship speed is to ensure that the main engine is safe and stable and not overload, so the closed-loop adjustment of ship speed in the disclosure is differential adjustment, and the deviation value $\Delta V_s$ between the actual speed value and the set speed value only has $\Delta V_s=0$ under ideal sea conditions and ideal ship conditions, and $\Delta V_s \neq 0$ under bad sea conditions, against wind and current and hull fouling, etc., and the final result of closed-loop adjustment of ship speed is that the main engine is not overload and stable, and the actual speed gradually stabilizes near the set speed value, but the situation that the actual speed oscillate around the set speed does not occur.

Compared with the prior ship speed control, the disclosure has the following advantages.

First, a speed closed-loop control system includes a detection feedback module, an outer-loop control module, a middle-loop control module and an inner-loop control module, and the outer-loop ship speed control is converted into the middle-loop main engine speed control by using each sub-module and algorithm in the outer-loop control module; the main engine speed controller and the main engine load limit sub-module in the middle-loop control module are used to control the main engine speed, and the middle-loop main engine speed control is converted into the inner-loop fuel quantity control; finally, through the inner-loop fuel quantity control module, the closed-loop automatic control of the ship speed is realized after fuel quantity optimization control, which makes the ship sail gradually and stably, runs safely and improves the navigation efficiency, thus meeting the requirements of stable, efficient, safe and reliable navigation.

Second, the closed-loop adjustment of ship speed in the disclosure is differential adjustment. Considering the bad sea conditions, abnormal ship conditions, abnormal propulsion system and other conditions, the actual speed is gradually stabilized near the set speed value through differential adjustment, so as to avoid the oscillation of the actual speed around the set speed, ensure the stability of the main engine and prevent the main engine from being overloaded.

Third, by setting the fuel quantity optimization control sub-module, the disclosure optimizes the proportional coefficient and the integral coefficient of the fuel quantity control intensity based on the matching characteristics of the actual ship speed and the actual propulsion shaft power, so as to realize the optimal matching between the ship and the main engine, thereby adapting to the changes of sea conditions or ship conditions, preventing frequent changes, fuel quantity overshoot or unstable main engine load, and improving the energy efficiency of the ship.

Fourth, according to the disclosure, a PID algorithm and a machine learning algorithm are adopted in the main engine speed controller, and the fuel quantity setting value is obtained from the speed deviation is obtained through PID operation, where the PID algorithm is the main one, and the machine learning algorithm is effective only after the PID algorithm acts; through the machine learning algorithm, the PID control parameters are finely adjusted or superimposed on the PID output, which plays an auxiliary role in compensation, optimizes the main engine speed adjustment process, prevents the main engine speed from overshoot, oscillation or untimely control, and ensures the stability of the main engine speed.

DETAILED DESCRIPTION OF THE EMBODIMENTS

In order to make the objective, technical scheme and advantages of the disclosure clearer, the technical scheme of the disclosure will be further explained below.

Figure 1:
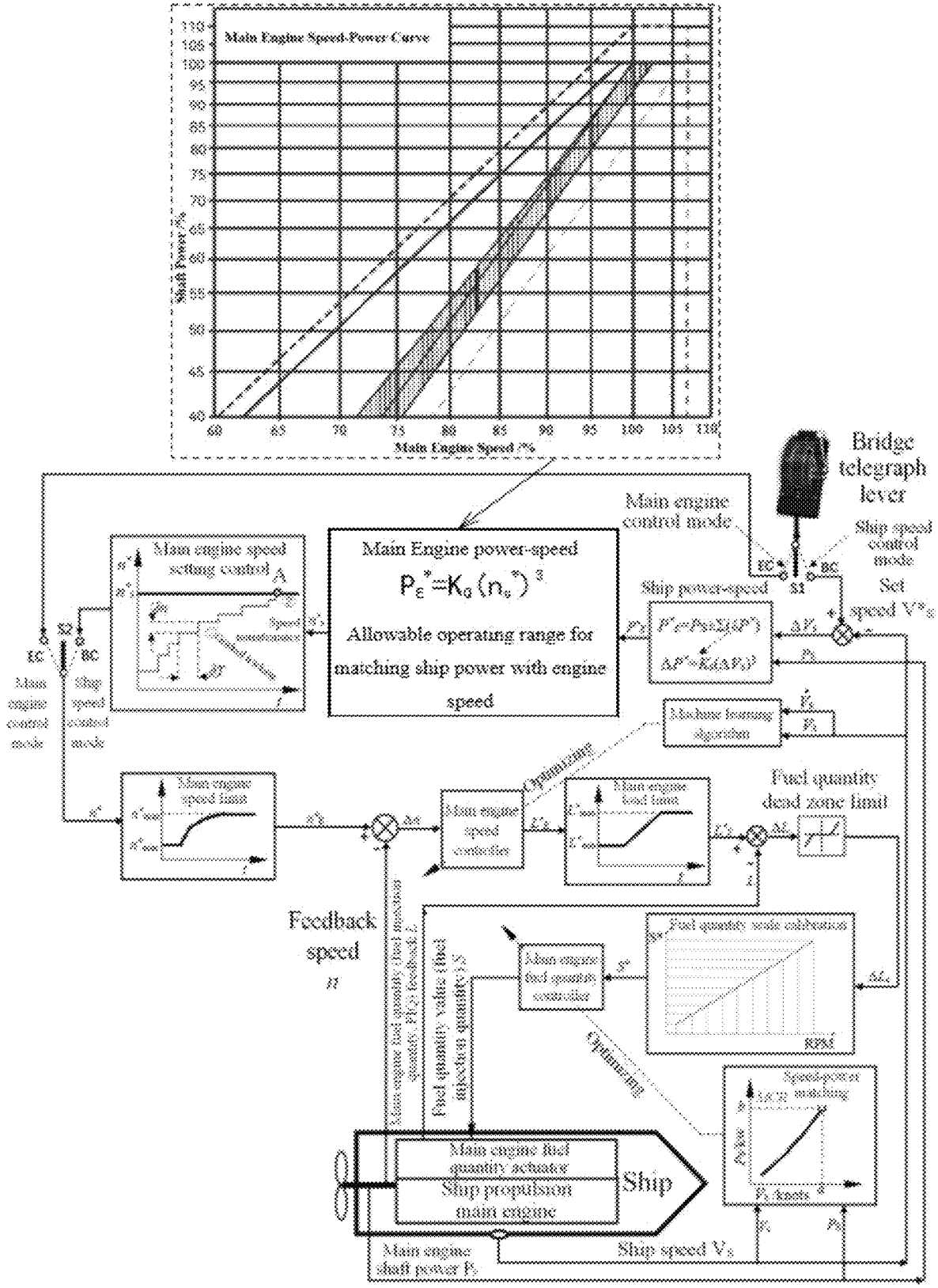
FIG. 1 is a structural schematic diagram of a closed-loop automatic control system for ship speed according to an embodiment of the present disclosure.

This embodiment proposes a closed-loop automatic control system for ship speed. As shown in FIG. 1, the system includes a function setting module, a detection feedback module, an outer-loop control module, a middle-loop control module and an inner-loop control module.

Among them, the function setting module has the functions of Telegraph transmitting and speed setting, and is used for setting engine orders, and an electric signal of 0-10 V, 0-5 V, ±5V or 4-20 mA is generated by a potentiometer as an engine order and speed setting values. The function setting module operates through the bridge telegraph lever to select the ship speed control mode or the main engine control mode. In this embodiment, the bridge telegraph lever has 11 positions, including dead-speed, slow-speed, half-speed, full-speed and emergency astern speed for astern (AS), dead-speed, slow-speed, half-speed, full-speed, navigation full for ahead (AH) and stop. When the telegraph lever selection switches S1 and S2 is set to the left position EC, the main engine control mode is selected, and the main engine speed is set, at this time, the main engine speed is controlled in closed-loop and the ship speed is controlled in open-loop. When the telegraph lever is set to the right position BC through the selector switches S1 and S2, the ship speed control mode is selected, and the ship speed $V_s$* is set. At this time, the speed is closed-loop controlled.

The detection feedback module is used to detect and obtain feedback information and convert the feedback information into feedback signals, and the feedback signals have to be scaled to meet the signal requirements of their respective closed-loop comparison links. In this embodiment, the feedback signals are analog signals of 4-20 mA or 1-5 V, and the feedback information includes the main engine shaft power $P_s$, the main engine speed n, the ship speed $V_s$ and the amount of fuel supplied to the main engine L. Among them, the main engine shaft power $P_s$ is detected by the shaft power meter, the main engine speed n is detected by the pulse generator at the flywheel, the ship speed $V_s$ is obtained by the voyage recorder or GPS, the fuel injection quantity (FIQ) L of the electric injection main engine is obtained by the displacement sensor of FIVA or the piston displacement sensor of the hydraulic high-pressure oil pump, and the FIQ L of the main engine of the mechanical high-pressure oil pump is detected by the displacement sensor or the servo actuator motor encoder.

The outer-loop control module receives the feedback signals obtained from the detection feedback module, and through the internal sub-module, converts the outer-loop ship speed control into the middle loop main engine speed control to obtain the main engine speed order $n_E$*; the outer-loop control module specifically includes the following sub-modules:

(a) ship power demand sub-module: based on the ship power-speed algorithm, used to generate the main engine power variable ΔP* by passing the speed deviation $\Delta V_s$ between the set speed $V_s$* and the actual speed $V_s$ through the ship resistance model, and then obtain the main engine power $P_E$* required by the ship through calculation;

the calculation formula 1 of speed deviation is: $\Delta V_s = V_s^* - V_s$;

Formula 2 of ship resistance model is: $\Delta P^* = K_S(\Delta V_s)^3$, where $K_S$ is the ship resistance coefficient, and the sea condition and ship condition will affect the value of $K_S$;

the calculation formula 3 of the main engine power $P_E$* required by the ship is: $P_E^* = P_s \pm \Sigma(\delta P^*)$, where $P_s$ is the propulsion power required by the ship at the corresponding speed, that is, the main engine shaft power obtained by the shaft power meter in the above feedback signal; $\Delta P^* = \Sigma(\delta P^*)$, Δp* is the power of each adjustment, so as to prevent the power step change caused by excessive single adjustment quantity of power and affect the stability of the main engine.

(b) a main engine speed generation sub-module: based on a main engine speed-power algorithm, used to obtain a main engine speed $n_s$* corresponding to the required speed of the ship from the main engine power $P_E$* required by the ship through a ship propulsion formula; the ship propulsion formula 4 is:

$$P_E^* = K_Q(n_s^*)^3$$

where $K_Q$ is the torque coefficient; meanwhile, $n_s^* - P_E^*$ is in the allowable range of ship propulsion characteristics, that is, meeting the ship-main engine matching design curve.

(c) The main engine speed setting sub-module: generating main engine speed order n* by using the main engine speed $n_s$* required by the ship through main engine speed order control, which automatically adapts to the ship speed and realizes the ship speed control;

the ways to realize ship speed control are divided into gradual tracking control (changing the set value of ship speed $V_s$*) and speed keeping control (constant value of $V_s$*):

The method of gradual tracking control is as follows: when the ship speed is under the control of follow-up or acceleration and deceleration program, in order to prevent the main engine from suddenly increasing or decreasing the load due to the large inertia of the ship, the order for the main engine speed n* is passed through the adjustable interval time δT and speed variation δ*n*, allowing the main engine speed given value to be gradually tracked to $n_s$*, so that the ship speed $V_s$ may be gradually tracked to the set speed $V_s$*; among them, the gradual tracking formula 5

$$n_s^* = n^* \pm \sum_i^m (\delta n),$$

where $\delta n$ is the absolute value type speed adjustment quantity, "+" means the speed increase adjustment, and "–" means the speed decrease adjustment;

$$T = \sum_{i}^{m} (\delta T),$$

m is the number of adjustments, i=0, 1, . . . m; T is the total adjustment time, $\delta T$ is the variable interval time of each adjustment, and $\delta T$ depends on the ship inertia. When the ship inertia is large, $\delta T$ is large, and when the ship inertia is small, $\delta T$ is small, so that the actual speed approaches the given speed in the form of ascending curve, so that the ship speed $V_s$ may gradually track the set speed $V_s$*.

The method of speed keeping control is as follows: when the speed keeps the constant value control of $V_s$*, when the actual ship speed $V_s$ deviates from the setting ship speed $|\Delta V_s| \leq V_{DB}$, $V_{DB}$ is a settable speed dead zone; when $\Delta V_s$ is within the speed dead zone, the ship speed controller does not act, and the $V_{DB}$ dead zone value may be set according to the sea conditions, such as $V_D$=0.1 knots in calm sea conditions, and $V_{DB}$=2 knots in bad sea conditions. If $\Delta V_s$ exceeds the ship speed dead zone, that is, $|\Delta V_s| > V_{DB}$, a new main engine set speed $n_s$* is generated, that is, $n_s^* = f(\Delta V_s)$, and the function $f(\Delta V_s)$ includes the ship power-speed algorithm and the main engine speed-power algorithm, that is:

$$f(\Delta V_s) = \sqrt[3]{\left[\eta\left(P_s \pm K_s(\Delta V_s)^3\right)\right] / \left(2\pi\rho D_p^5 K_Q\right)},$$

where $\eta$ is the efficiency of the main engine propulsion system, $\rho$ is the seawater density, $D_p$ is the diameter of the propulsion propeller, $K_Q$ is the torque coefficient, and $P_s$ is the propulsion power required by the ship at the corresponding speed.

(d) The main engine speed order limiting sub-module is used to generate a final effective main engine speed order $n_E$* after the main engine speed order n* passes a speed limit. In the main engine speed order limiting sub-module, the main engine speed order n* output by ship speed control needs to go through the main engine speed limit link, including the minimum stable speed limit, critical speed limit, engine control room (chief engineer) limit, acceleration rate limit, program load limit and maximum speed limit. The main engine speed order n* with these speed limits are compared, and if n* exceeds these limits, n* will not work, so the speed order selects the speed limit value, and after passing the speed limit, the final main engine speed order is $n_E$*.

In this embodiment, the middle-loop control module is used to realize the closed-loop control of the main engine speed and convert the middle-loop main engine speed control into the inner-loop fuel quantity control; the middle-loop control module includes a main engine speed closed-loop control sub-module and a main engine load limit sub-module, where the main engine speed closed-loop control sub-module is used for converting the speed deviation $\Delta n$ compared with the main engine speed order $n_E$* and the main engine speed n through a main engine speed controller to obtain a set value $L_E$* of the amount of fuel supplied to the engine; the calculation formula 6 of speed deviation $\Delta n$ is: $\Delta n = n_E^* - n$; the main engine speed controller mainly adopts PID algorithm, supplemented by machine learning algorithm; the ship speed $V_s$ and the change compensation PID speed adjustment algorithm is learned, and the machine learning algorithm will only be effective after PID action; PID control parameters include proportional coefficient $K_p$, integral coefficient $K_i$ and differential coefficient $K_d$, which need manual experience setting and online optimization. The machine learning algorithm is a speed machine learning algorithm, such as fuzzy neural network, genetic algorithm, evolutionary algorithm, particle swarm optimization algorithm, support vector machine, etc. The machine learning algorithm is used to fine-tune PID control parameters or superimpose them on PID output, and as a compensation function, machine learning algorithm may prevent the main engine speed from overshoot, oscillation or untimely control.

In addition, the main engine load limit sub-module is used for generating a final effective main engine fuel quantity order $L_S$* after the set value $L_E$* of the amount of fuel supplied to the engine is subjected to load limit processing. Load limits include minimum fuel injection limit, starting fuel quantity setting, Scavenging air pressure limit, torque limit and maximum fuel quantity limit. Comparing the set value $L_E$* of the amount of fuel supplied to the engine with these load limits, if $L_E$* exceeds the load limits, $L_E$* will not work, and the fuel quantity order will select the load limit value, and finally an effective fuel quantity order as $L_S$* is generated after passing the load limits.

The inner-loop control module is used to realize the closed-loop adjustment of the main engine fuel injection quantity (FIQ), so as to realize the closed-loop automatic control of the ship speed; the inner-loop control module includes the following sub-modules:

(a) fuel quantity limit sub-module: used to compare the main engine fuel quantity order $L_S$* obtained from the main engine load limit sub-module with the fuel quantity feedback signal L to obtain the fuel quantity deviation $\Delta L$, and then the fuel quantity deviation $\Delta L$ is subjected to fuel quantity dead zone limit processing to generate $\Delta L_S$; among them, the fuel quantity deviation calculation formula 7 is: $\Delta L = L_S^* - L$; the fuel quantity dead zone limit processing method is as follows: comparing $|\Delta L|$ with the settable fuel quantity dead zone $L_{DB}$, and the dead zone value of $L_{DB}$ may be set according to the sea conditions; the dead zone value of $L_{DB}$ is the minimum value in calm sea conditions and the maximum value in bad sea conditions to prevent the fuel quantity from moving frequently; when $|\Delta L| \leq L_{DB}$, when $\Delta L$ is in the dead zone, the output of the fuel quantity controller remains unchanged, and the fuel quantity actuator does not act; when $|\Delta L| > L_{DB}$, the output of the fuel quantity controller starts to change, and the fuel quantity adjusting mechanism acts.

(b) FIQ scale calibration sub-module: $\Delta L_S$ generated by the fuel quantity limit sub-module is subjected to FIQ-speed calibration to generate a fuel quantity order S* after the FIQ scale calibration; specifically, the FIQ scale calibration signal of 1-5 V or 4-20 mA and the main engine speed signal are calibrated to improve the adjustment accuracy of the FIQ position, and the FIQ calibrated by the FIQ scale calibration, that is, the fuel injection order, is recorded as S*.

(c) FIQ-speed calibration processing method: $\Delta L_S$ is calibrated by FIQ scale signal (ordinate) and main engine speed signal (abscissa) to improve the adjustment accuracy of fuel quantity position, and the FIQ order after fuel quantity scale calibration is S*.

(d) the FIQ scale adjustment sub-module: used for passing the FIQ order S* through a fuel quantity controller to generate a FIQ value S; among them, the fuel quantity order S* is the given value of the fuel quantity actuator, which is divided into servo motor fuel rack position control and FIVA or ELFI hydraulic fuel injection quantity control. The former has an angle encoder to complete the closed-loop adjustment of fuel rack scale value, and the latter uses displacement sensor to detect the stroke of fuel injection plunger to complete the closed-loop adjustment of FIQ.

due to the great difference of fuel quality burned by the main engine, the power generated by the main engine is different after the fuel with the same injection quantity is burned, which will lead to the control system misjudging whether the control function is weak or strong and further increasing or decreasing the FIQ; on the other hand, bad sea conditions, against wind and current, hull fouling, etc. will increase the ship's resistance and make the ship speed-propulsion power matching abnormal. Therefore, the fuel quantity controller is also equipped with a fuel quantity optimization control sub-module:

the fuel quantity optimization control sub-module compares and analyzes the actual ship speed $V_s$- actual propulsion shaft power $P_s$ matching curve with the ideal speed-power matching curve based on the ship speed (abscissa)-power (ordinate) matching curve, and use the fuel quantity actuator to optimize fuel quantity control and realize fuel quantity closed-loop adjustment.

In this embodiment, the fuel quantity controller mainly adopts PI control algorithm, and utilizes the fuel quantity optimization control sub-module to optimize the proportional coefficient and integral coefficient of fuel quantity control intensity, so as to realize the optimal matching between the ship and the main engine, prevent frequent changes, fuel quantity overshoot and unstable load of the main engine, and adapt to changes in sea conditions and ship conditions, such as against wind and current or hull fouling, etc. If the $V_s$-$P_s$ curve becomes steep, the control coefficient of the fuel quantity controller PT will be weakened to prevent the main engine from being overloaded. Through the fuel quantity controller, the specific method of fuel quantity optimization control is as follows:

the actual ship speed $V_s$- power $P_s$ matching curve and the ideal speed-power matching curve are compared and analyzed as follows:

1) if the $V_s$-$P_s$ matching curve is steeper than the ideal speed-power matching curve, that is, more propulsion power is needed at the same speed, and the main engine FIQ becomes larger, which indicates that the ship resistance becomes larger, at this time, the control system may not further increase the FIQ to meet the set speed, and it is allowed that the actual speed does not reach the given speed, so as to prevent the main engine from being overloaded and the ship's energy efficiency from getting worse.

2) If the $V_s$-$P_s$ matching curve is below the ideal speed-power matching curve, that is, less propulsion power is needed at the same speed, and the main engine FIQ becomes smaller, indicating that the ship is downwind and downstream, and the resistance is reduced. At this time, the control system will further reduce the FIQ until the actual speed is kept within a given speed range, so as to realize the fuel saving of the main engine and improve the energy efficiency of the ship.

3) The $V_s$-$P_s$ matching curve is the best matching, and the fuel rack scale or fuel quantity value adjustment link is directly optimized to prevent the ship speed control from oscillating and the fuel quantity from entering saturation.

Figure 2:
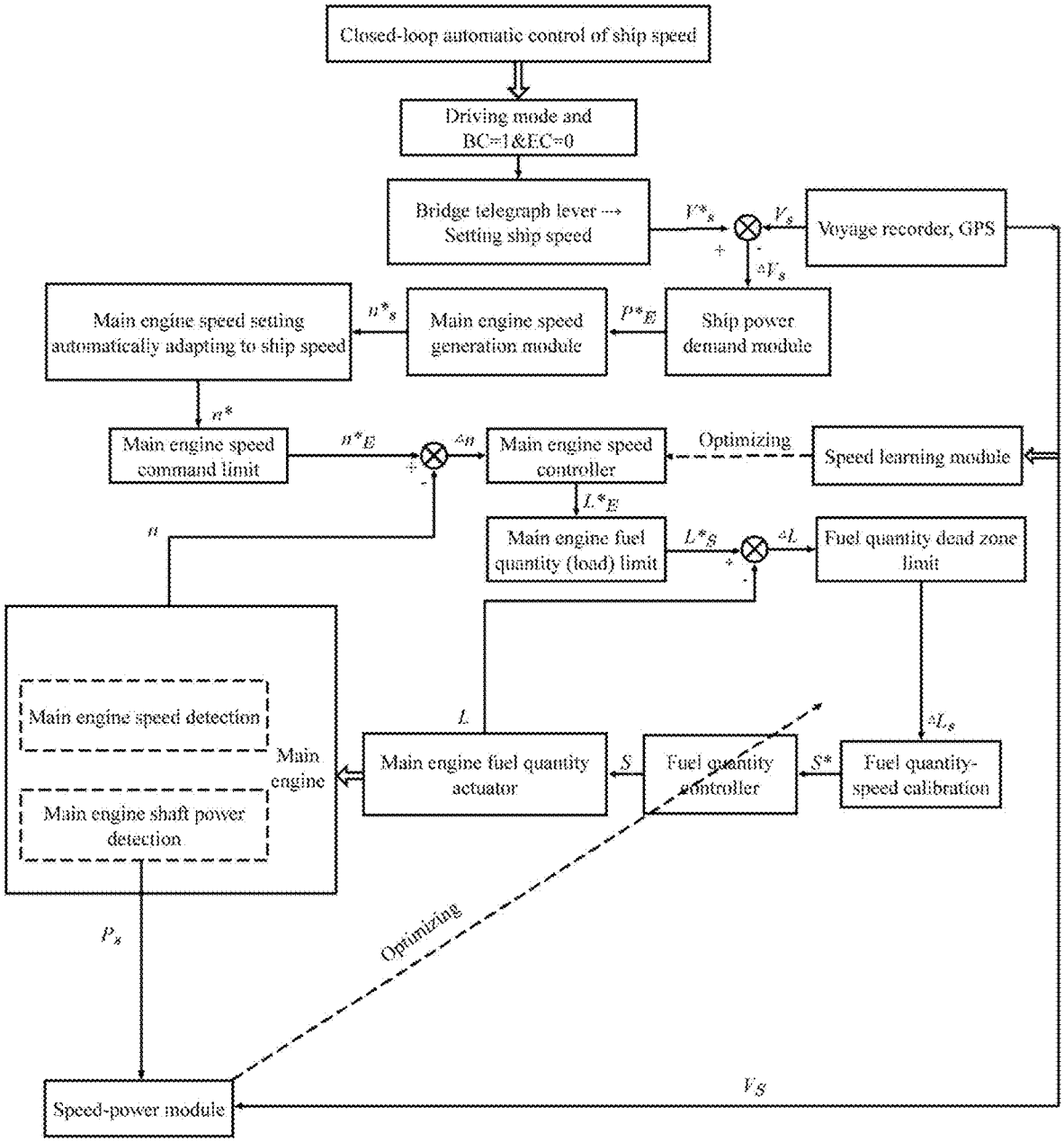
FIG. 2 is a flow schematic diagram of a closed-loop automatic control method for ship speed according to the embodiment of the present disclosure.

Through the closed-loop automatic control system for ship speed proposed in the above embodiment, the method flow for realizing the closed-loop automatic control of ship speed is shown in FIG. 2, specifically including the following steps.

S1, obtaining the feedback information through the detection feedback module, where the feedback information includes the main engine shaft power $P_s$, the main engine speed n, the ship speed $V_s$ and the amount of fuel supplied to the main engine L;

S2, passing the speed deviation $\Delta V_s$ between the set speed $V_s$* and the actual speed $V_s$ through the outer-loop control module to generate the final effective main engine speed order $n_E$*, so as to realize a conversion from the outer-loop ship speed control to the middle-loop main engine speed control;

2.1: through formula 1, the speed deviation $\Delta V_s$ between the set speed $V_s$* and the actual speed $V_s$ of the ship is obtained;

2.2: through the ship power demand sub-module, the main engine power variable ΔP* is generated from the ship speed deviation $\Delta V_s$ according to formula 2, and then the power $P_E$* of the main engine required by the ship is obtained according to formula 3;

2.3: through the main engine speed generation sub-module, the main engine power $P_E$* required by the ship is substituted into formula 4 to obtain the main engine speed $n_s$* required by the ship;

2.4: the main engine speed $n_s$* required by the ship is input into the main engine speed setting sub-module to generate the main engine rotating order n*;

2.5: the main engine speed order n* is input into the main engine speed order limiting sub-module to obtain the final main engine speed order $n_E$* generated after the speed limit.

S3, converting the speed deviation Δn compared with the main engine speed order $n_E$ and the main engine speed n through the middle-loop control module to generate the final effective main engine fuel quantity order $L_S$*, so as to realize a conversion from the middle-loop main engine speed control to the inner-loop fuel quantity control;

3.1: through formula 6, the speed deviation Δn between the main engine speed order $n_E$* and the main engine speed n is obtained;

3.2: An is input into the main engine speed controller to obtain the main engine fuel quantity order $L_E$*;

3.3: the main engine fuel quantity order $L_E$* is input into the main engine load limit sub-module, and the final effective main engine fuel quantity order $L_S$* is generated after load limit processing.

S4, comparing the main engine fuel quantity order $L_S$* with the fuel quantity feedback signals L to obtain the fuel quantity deviation ΔL, and generating an optimized fuel quantity value S through the inner-loop control module to realize the fuel quantity closed-loop adjustment.

4.1: using formula 7, the fuel quantity deviation ΔL between the effective main engine fuel quantity order $L_S$* and the amount of fuel supplied to the engine L is obtained;

4.2: the fuel quantity deviation $\Delta L$ is input into the fuel quantity limit sub-module, and $\Delta L_s$ is generated after the fuel quantity dead zone limit processing;

4.3: the generated $\Delta L_S$ is passed through the fuel quantity scale calibration sub-module, and after the FIQ-speed calibration process, the calibrated fuel quantity order S* is generated;

4.4: the fuel quantity order S* calibrated by the fuel quantity scale is input into the fuel quantity scale adjustment sub-module, and through the fuel quantity controller, the fuel quantity displacement/FIQ is generated, namely the fuel quantity value S; the fuel quantity value S is transmitted to the fuel quantity actuator for fuel quantity adjustment, so as to change the FIQ into the cylinder by the main engine in each cycle.

The above is only the preferred embodiment of the present disclosure, and does not play any limiting role on the present disclosure. Any technical personnel in the technical field who make any form of equivalent substitution, modification and other changes to the technical scheme and technical content disclosed in the present disclosure within the scope of the technical scheme of the present disclosure belongs to the content of the technical scheme of the present disclosure and still belongs to the protection scope of the present disclosure.

What is claimed is:

1. A closed-loop automatic control system for ship speed, comprising:

a detection feedback module, used for detecting and acquiring feedback information and converting the feedback information into feedback signals;

an outer-loop control module, used for converting outer-loop ship speed control into middle-loop main engine speed control by using the feedback signals;

a middle-loop control module, used for realizing closed-loop control of a main engine speed and converting the middle-loop main engine speed control into inner-loop fuel quantity control; and an inner-loop control module, used for realizing a closed-loop adjustment of a main engine fuel quantity, so as to realize closed-loop automatic control of the ship speed.

2. The closed-loop automatic control system for ship speed according to claim 1, wherein the feedback information comprises a main engine shaft power $P_s$, a main engine speed n, the ship speed $V_s$ and an amount of fuel supplied to the main engine L.

3. The closed-loop automatic control system for ship speed according to claim 2, wherein the system is started by a function setting module, and the function setting module is used for transmitting engine orders and selecting a ship speed control mode or a main engine control mode; the closed-loop automatic control system for the ship speed is started by selecting the ship speed control mode; in the ship speed control mode, the ship speed $V_s$* is set.

4. The closed-loop automatic control system for ship speed according to claim 3, wherein the outer-loop control module comprises:

a ship power demand sub-module: based on a ship power-speed algorithm, used to generate a main engine power variable $\Delta P$* by passing a speed deviation $\Delta V_s$ between a set speed $V_s$* and an actual speed $V_s$ through a ship resistance model, and then obtain a main engine power $P_E$* required by a ship through a calculation;

a main engine speed generation sub-module: based on a main engine speed-power algorithm, used to obtain a main engine speed $n_s$* corresponding to the required speed of the ship from the main engine power $P_E$* required by the ship through a ship propulsion formula;

a main engine speed setting sub-module: generating a main engine speed order n* by using the main engine speed $n_s$* required by the ship through main engine speed order control to realize ship speed control; and a main engine speed order limiting sub-module, used to generate a final effective main engine speed order $n_E$* after the main engine speed order n* passes a speed limit.

5. The closed-loop automatic control system for ship speed according to claim 4, wherein in the main engine speed setting sub-module, the ship speed control realized is divided into gradual tracking control and speed keeping control:

a method of the gradual tracking control is as follows: when the ship speed is under a control of follow-up or acceleration and deceleration program, the main engine speed order n* is passed through an adjustable interval time $\delta T$ and a speed variation $\delta n$, so that a main engine speed given value gradually tracks to $n_s$*, so that the ship speed $V_s$ gradually tracks to the set speed $V_s$*;

a method of the speed keeping control is as follows: when the speed keeps a constant value control of $V_s$*, and an actual ship speed $V_s$ deviates from a given ship speed $|\Delta V_s| \leq V_{DB}$, $V_{DB}$ is a settable speed dead zone; when $\Delta V_s$ is within the speed dead zone, a ship speed controller does not act, and a $V_{DB}$ dead zone value is set according to sea conditions; if $\Delta V_s$ exceeds a ship speed dead zone, that is, $|\Delta V_s| > V_{DB}$, a new main engine set speed $n_s$* is generated, $n_s^* = f(\Delta V_s)$, and a function $f(\Delta V_s)$ comprises the ship power-speed algorithm and the main engine speed-power algorithm.

6. The closed-loop automatic control system for ship speed according to claim 4, wherein the middle-loop control module comprises a main engine speed closed-loop control sub-module and a main engine load limit sub-module:

the main engine speed closed-loop control sub-module is used for converting a speed deviation $\Delta n$ compared with the main engine speed order $n_E$* and the main engine speed n through a main engine speed controller to obtain a set value $L_E$* of the amount of fuel supplied to the engine; and the main engine load limit sub-module is used for generating a final effective main engine fuel quantity order $L_S$* after the set value $L_E$* of the amount of fuel supplied to the engine is subjected to load limit processing.

7. The closed-loop automatic control system for ship speed according to claim 6, wherein the main engine speed controller adopts a PID algorithm as a main part and a machine learning algorithm as an auxiliary part, wherein the machine learning algorithm is used to fine-tune PID control parameters or compensate on a PID output.

8. The closed-loop automatic control system for ship speed according to claim 6, wherein the inner-loop control module comprises:

a fuel quantity limit sub-module: used for comparing the main engine fuel quantity order $L_S$* with fuel quantity feedback signals L to obtain a fuel quantity deviation $\Delta L$, and generating $\Delta L_S$ after a fuel quantity dead zone limit processing;

a fuel quantity scale calibration sub-module: after the generated $\Delta L_S$ is calibrated by a fuel quantity-speed, a fuel quantity order S* after a fuel quantity scale calibration is generated;

a fuel quantity scale adjustment sub-module: used for passing the fuel quantity order S* through a fuel quantity controller to generate a fuel quantity value S; and the fuel quantity controller is also provided with a fuel quantity optimization control sub-module, and the fuel quantity optimization control sub-module compares and analyzes ship actual speed $V_s$-actual propulsion shaft power $P_s$ matching curve with an ideal speed-power matching curve based on a ship speed-power matching curve, and carries out fuel quantity optimization control through a fuel quantity actuator to realize fuel quantity closed-loop adjustment.

9. The closed-loop automatic control system for ship speed according to claim 8, wherein in the fuel quantity limit sub-module, a method of the fuel quantity dead zone limit processing comprises:

comparing $|\Delta L|$ with a settable fuel quantity dead zone $L_{DB}$, wherein a dead zone value of $L_{DB}$ is capable of being set according to sea conditions, in calm sea conditions, $L_{DB}$ is a minimum value, and in bad sea conditions, $L_{DB}$ is a maximum value, so as to prevent frequent fuel quantity action;

when $|\Delta L| \leq L_{DB}$, when $\Delta L$ is in a dead zone, an output of the fuel quantity controller remains unchanged, and the fuel quantity actuator does not act; and when $|\Delta L| > L_{DB}$, the output of the fuel quantity controller starts to change, and the fuel quantity adjusting mechanism acts.

10. A closed-loop automatic control method for ship speed, based on the closed-loop automatic control system for the ship speed according to claim 1, comprising following steps:

S1, obtaining the feedback information through the detection feedback module, wherein the feedback information comprises the main engine shaft power $P_s$, the main engine speed n, the ship speed $V_s$ and the amount of fuel supplied to the main engine L;

S2, passing the speed deviation $\Delta V_s$ between the set speed $V_s$* and the actual speed $V_s$ through the outer-loop control module to generate the final effective main engine speed order $n_E$*, so as to realize a conversion from the outer-loop ship speed control to the middle-loop main engine speed control;

S3, converting the speed deviation $\Delta n$ compared with the main engine speed order $n_E$* and the main engine speed n through the middle-loop control module to generate the final effective main engine fuel quantity order $L_S$*, so as to realize a conversion from the middle-loop main engine speed control to the inner-loop fuel quantity control; and S4, comparing the main engine fuel quantity order $L_S$* with the fuel quantity feedback signals L to obtain the fuel quantity deviation $\Delta L$, and generating an optimized fuel quantity value S through the inner-loop control module to realize the fuel quantity closed-loop adjustment.

* * * * *